US011532287B2

(12) United States Patent
Zhang et al.

(10) Patent No.: US 11,532,287 B2
(45) Date of Patent: Dec. 20, 2022

(54) ELECTRODE DRIVE CIRCUIT OF A MICROFLUIDIC APPARATUS, A MICROFLUIDIC APPARATUS AND A DRIVE METHOD

(71) Applicant: BOE Technology Group Co., Ltd., Beijing (CN)

(72) Inventors: Ping Zhang, Beijing (CN); Haisheng Wang, Beijing (CN); Xiaoliang Ding, Beijing (CN); Yingming Liu, Beijing (CN); Xueyou Cao, Beijing (CN); Pengpeng Wang, Beijing (CN); Likai Deng, Beijing (CN); Pinchao Gu, Beijing (CN); Yunke Qin, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 516 days.

(21) Appl. No.: 16/630,854

(22) PCT Filed: Apr. 30, 2019

(86) PCT No.: PCT/CN2019/085223
§ 371 (c)(1),
(2) Date: Jan. 13, 2020

(87) PCT Pub. No.: WO2020/140356
PCT Pub. Date: Jul. 9, 2020

(65) Prior Publication Data

US 2021/0074227 A1 Mar. 11, 2021

(30) Foreign Application Priority Data

Jan. 3, 2019 (CN) ..... 201910004244.X

(51) Int. Cl.
*G09G 3/34* (2006.01)
*B01L 3/00* (2006.01)

(52) U.S. Cl.
CPC ..... *G09G 3/348* (2013.01); *B01L 3/502784* (2013.01); *B01L 2300/0645* (2013.01);
(Continued)

(58) Field of Classification Search
None
See application file for complete search history.

(56) References Cited

U.S. PATENT DOCUMENTS

2008/0261276 A1 10/2008 Ponjee et al.
2010/0001666 A1 1/2010 Johnson et al.
(Continued)

FOREIGN PATENT DOCUMENTS

CN 1588090 A 3/2005
CN 101267887 A 9/2008
(Continued)

OTHER PUBLICATIONS

OA1 in CN201910004244.X.
OA2 in CN201910004244.X.
ISR & WO in PCT/CN2019/085223.

*Primary Examiner* — J. Christopher Ball
(74) *Attorney, Agent, or Firm* — IPro, PLLC

(57) ABSTRACT

Disclosed herein is an apparatus comprising: a first switch and a second switch; wherein the first switch is configured to apply a drive signal to a first electrode when the first switch receives a control signal; wherein the second switch is configured to electrically isolate the first electrode from a second electrode when the second switch receives the control signal; wherein the second switch is configured to short-circuit the first electrode to the second electrode when the second switch does not receive the control signal; wherein the first electrode and the second electrode face
(Continued)

each other and are separated by a gap configured to accommodate a liquid droplet.

17 Claims, 10 Drawing Sheets

(52) U.S. Cl.
CPC ..... *B01L 2300/165* (2013.01); *G09G 2310/0243* (2013.01)

(56) References Cited

U.S. PATENT DOCUMENTS

| | | | |
|---|---|---|---|
| 2012/0099069 | A1 | 4/2012 | Yoshiga |
| 2014/0054174 | A1 | 2/2014 | Wang |
| 2017/0061917 | A1 | 3/2017 | Chen et al. |
| 2018/0085756 | A1 | 3/2018 | Kosaka et al. |
| 2019/0070602 | A1 | 3/2019 | Han et al. |

FOREIGN PATENT DOCUMENTS

| | | | |
|---|---|---|---|
| CN | 101501333 | A | 8/2009 |
| CN | 102456314 | A | 5/2012 |
| CN | 102671724 | A | 9/2012 |
| CN | 104903003 | A | 9/2015 |
| CN | 105096888 | A | 11/2015 |
| CN | 106155449 | A | 11/2016 |
| CN | 107583694 | A | 1/2018 |
| CN | 107754962 | A | 3/2018 |
| CN | 107918206 | A | 4/2018 |
| CN | 108172157 | A | 6/2018 |
| JP | 4022990 | B2 | 12/2007 |
| WO | 2008020374 | A2 | 2/2008 |

ELECTRODE DRIVE CIRCUIT OF A MICROFLUIDIC APPARATUS, A MICROFLUIDIC APPARATUS AND A DRIVE METHOD

TECHNICAL FIELD

The disclosure herein relates to technical field of microfluidic control, particularly relates to an electrode drive circuit of a microfluidic apparatus, a microfluidic apparatus and a drive method.

BACKGROUND

Microfluidics is a technology to control directional movement (such as flow, splitting, fusion, etc.) of a micro liquid droplet. Microfluidics is widely applied in fields of medicine, chemistry, biology, etc. At present, microfluidics mainly involves placing a liquid droplet in a hydrophobic layer, enhancing wettability between the liquid droplet and the hydrophobic layer through electrical wetting effect by applying electric voltage between the liquid droplet and the hydrophobic layer, and thus forming asymmetric deformation of the liquid droplet, generating internal pressure differential and achieving directional movement of the liquid droplet.

A plurality of independent drive electrodes are usually arranged on a side of the hydrophobic layer. This side of the hydrophobic layer is away from the liquid droplet. A common electrode is arranged on a side of the liquid droplet. This side of the liquid droplet is away from the drive electrode. The common electrode may be electrically grounded. An external electric voltage is applied to a target drive electrode through a transistor. An electric voltage is formed between the liquid droplet and the hydrophobic layer under action of electric voltage between the drive electrode and the common electrode. Thus, the liquid droplet is driven to move directionally.

However, when there is leakage in the transistor, the transistor can charge a drive electrode that is not targeted, thereby causing the liquid droplet not to be able to move on a predefined path.

SUMMARY

Disclosed herein is an apparatus comprising: a first switch and a second switch. The first switch is configured to apply a drive signal to a first electrode when the first switch receives a control signal. The second switch is configured to electrically isolate the first electrode from a second electrode when the second switch receives the control signal. The second switch is configured to short-circuit the first electrode to the second electrode when the second switch does not receive the control signal. The first electrode and the second electrode face each other and are separated by a gap configured to accommodate a liquid droplet.

According to an embodiment, the first switch is a transistor. A gate electrode of the transistor is configured to receive the control signal. A source electrode of the transistor is configured to receive the drive signal and a drain electrode of the transistor is electrically connected to the first electrode, or the drain electrode is configured to receive the drive signal and the source electrode is electrically connected to the first electrode.

According to an embodiment, the second switch is a transistor. A gate electrode of the transistor is configured to receive the control signal. A source electrode of the transistor is electrically connected to the first electrode and a drain electrode of the transistor is electrically connected to the second electrode, or the drain electrode is electrically connected to the first electrode and the source electrode is electrically connected to the second electrode.

According to an embodiment, the drive signal is an electric voltage.

According to an embodiment, the control signal is an electric voltage.

According to an embodiment, the first switch is an enhancement-mode transistor.

According to an embodiment, the second switch is a depletion-mode transistor.

According to an embodiment, the first switch is a p-channel transistor and the second switch is an n-channel transistor; or the first switch is an n-channel transistor and the second switch is a p-channel transistor.

According to an embodiment, the apparatus further comprises the first electrode and the second electrode.

According to an embodiment, the gap is confined in a channel configured to allow flow of the liquid droplet.

According to an embodiment, the apparatus further comprises a first substrate and a second substrate. The first electrode is on the first substrate and the second electrode is on the second substrate.

According to an embodiment, the first substrate comprises an array of electrodes comprising the first electrode.

According to an embodiment, the gap is lined by a layer of hydrophobic material.

According to an embodiment, the apparatus further comprises a signal source configured to supply the drive signal.

Disclosed herein is a method comprising: supplying a drive signal to a first electrode while the first electrode is electrically isolated from a second electrode; short-circuiting the first electrode to the second electrode while not supplying the drive signal to the first electrode. The first electrode and the second electrode face each other and are separated by a gap configured to accommodate a liquid droplet.

According to an embodiment, the drive signal is an electric voltage.

According to an embodiment, supplying the drive signal to the first electrode attracts a liquid droplet into the gap.

DETAILED DESCRIPTION

Figure 1:
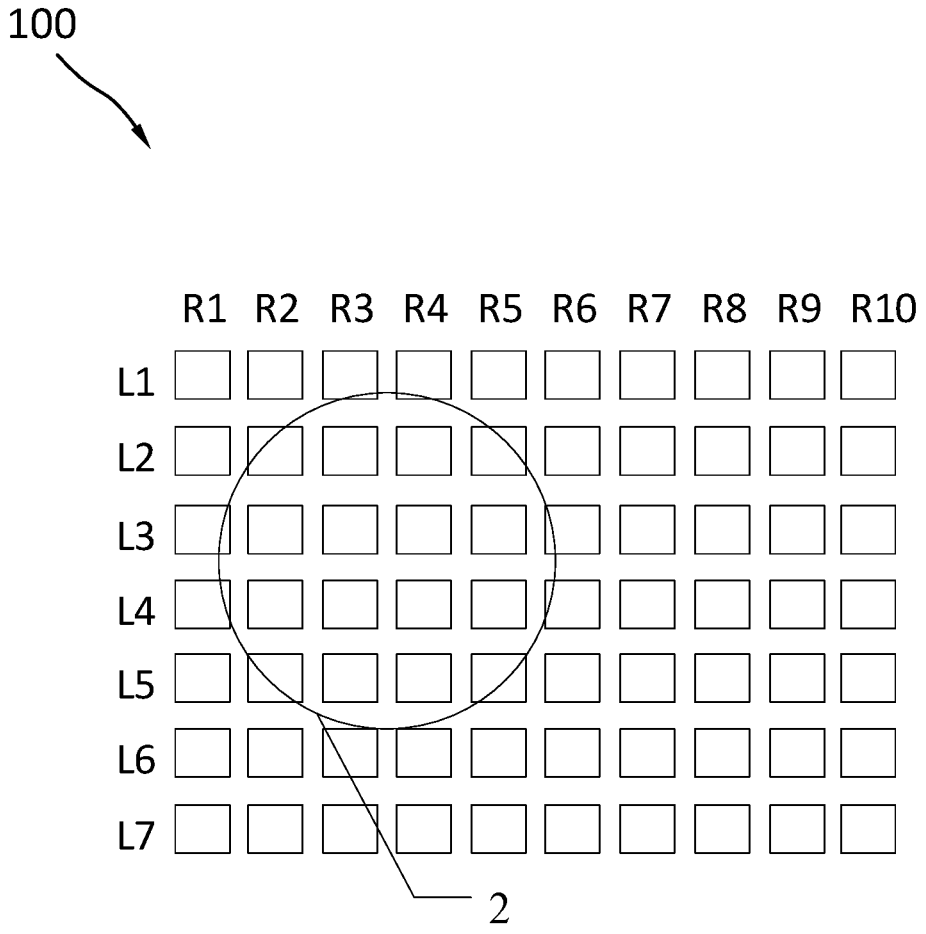
FIG. 1 schematically shows a structural diagram of a microfluidic apparatus.
Figure 2:
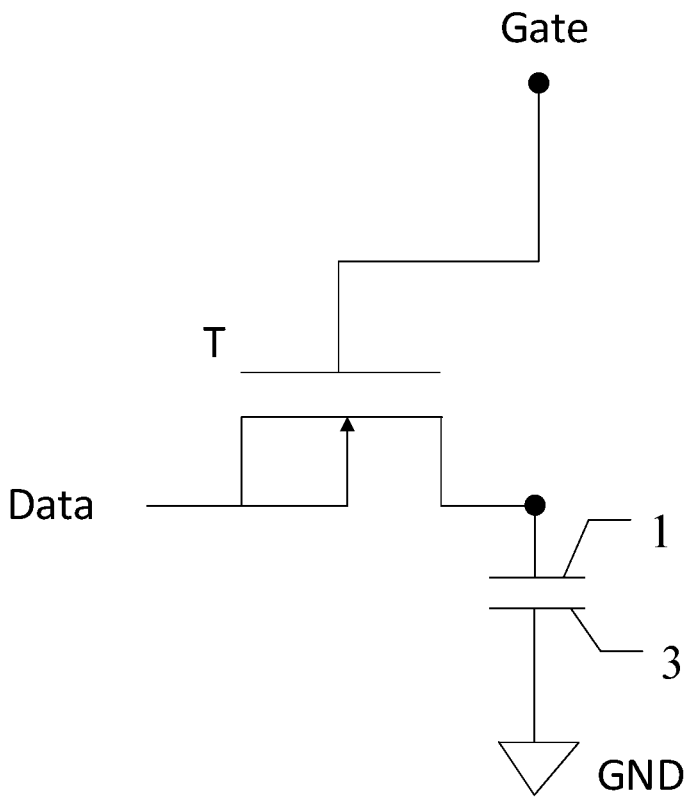
FIG. 2 is a diagram for an electrode drive circuit of the microfluidic apparatus.
Figure 3:
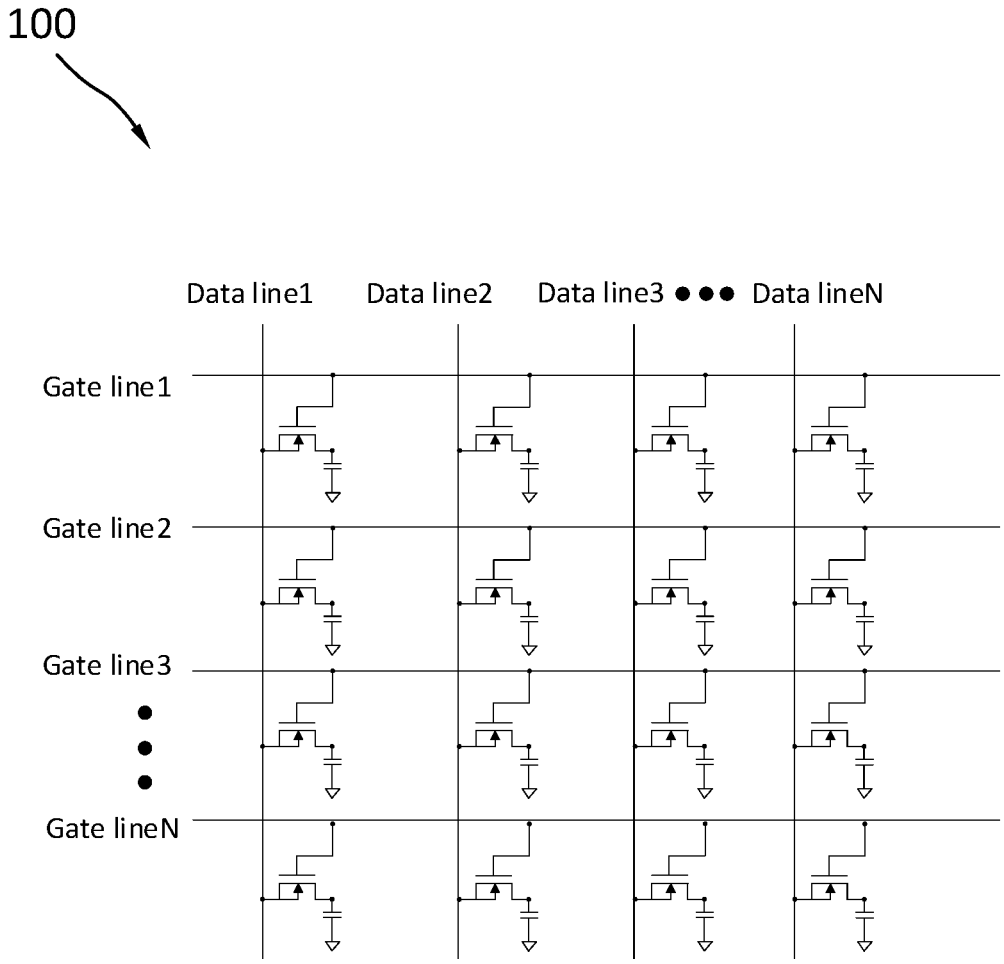
FIG. 3 is a structural diagram of a circuit of the microfluidic apparatus.
Figure 4:
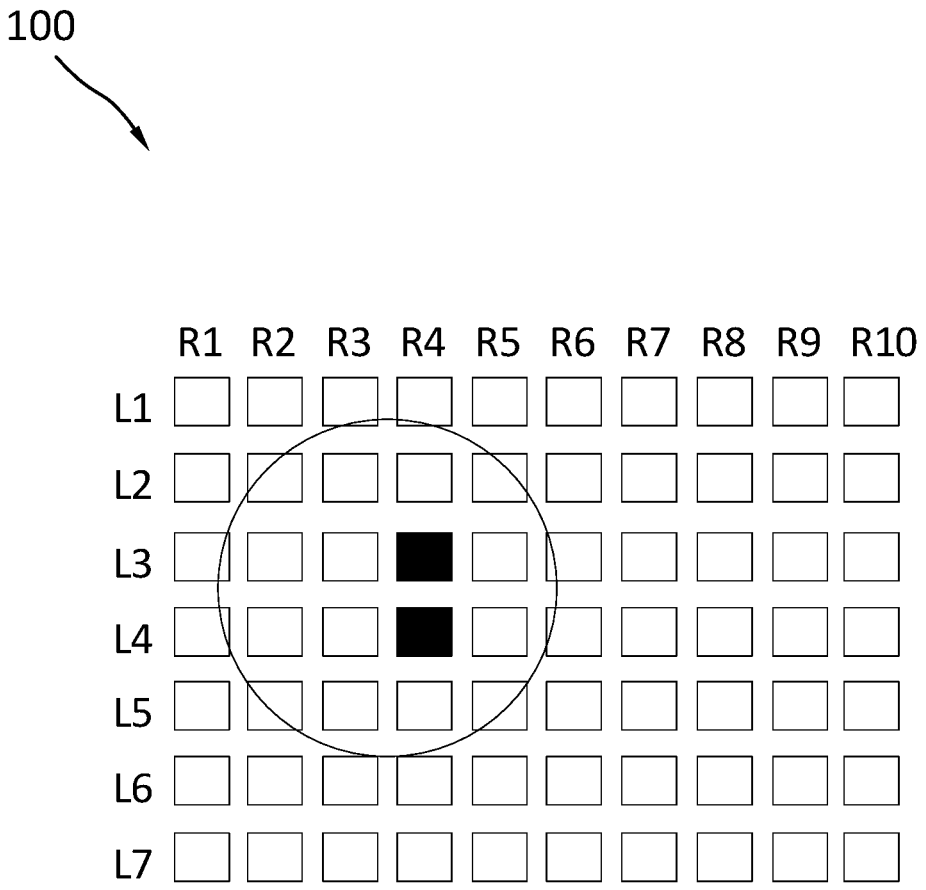
FIGS. 4-6 are diagrams showing a liquid droplet being driven in the microfluidic apparatus.
Figure 5:
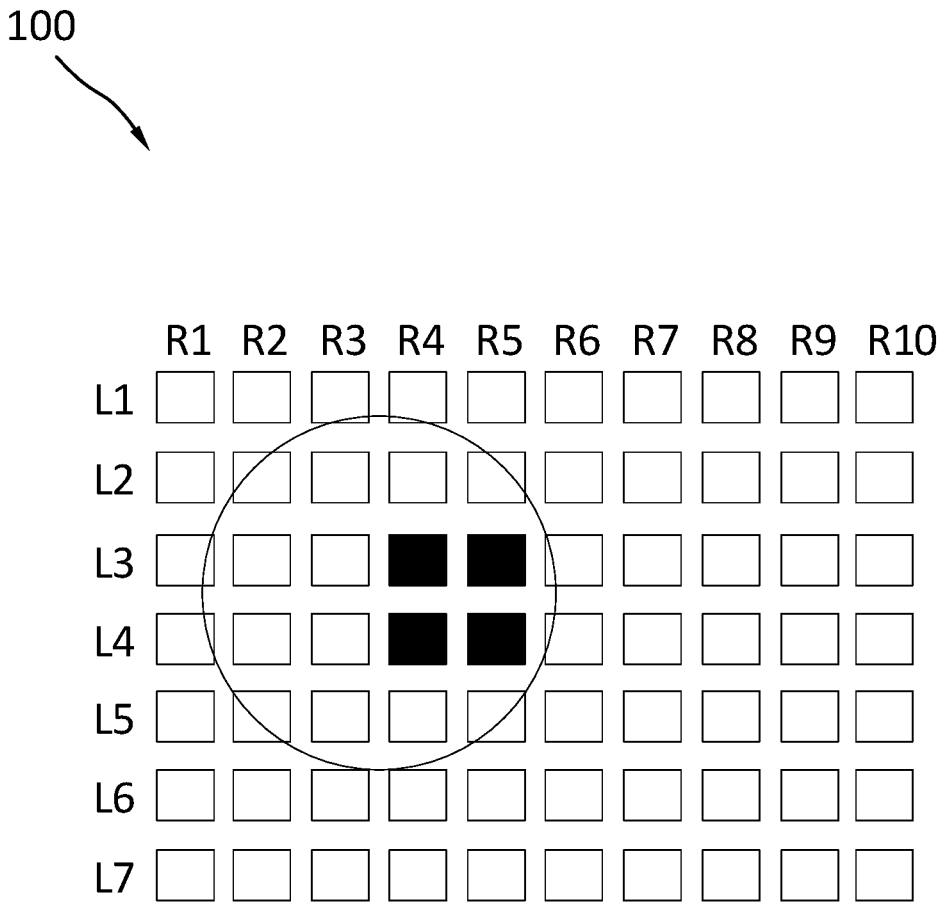
Figure 6:
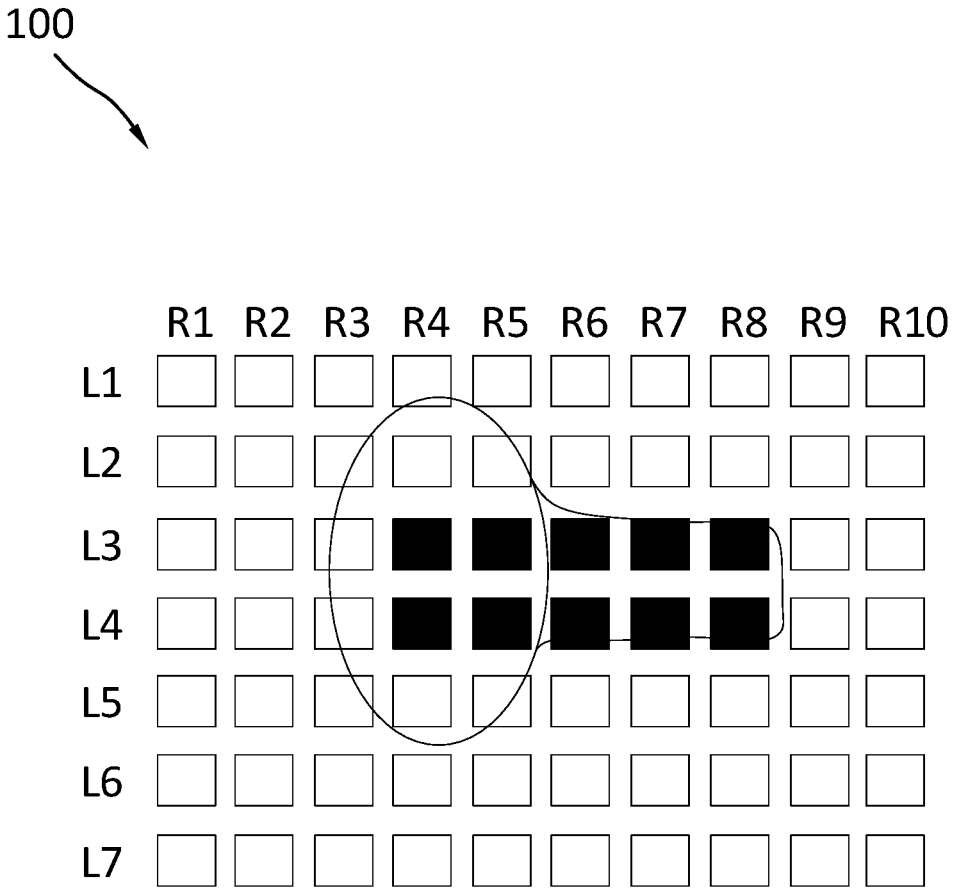
Figure 7:
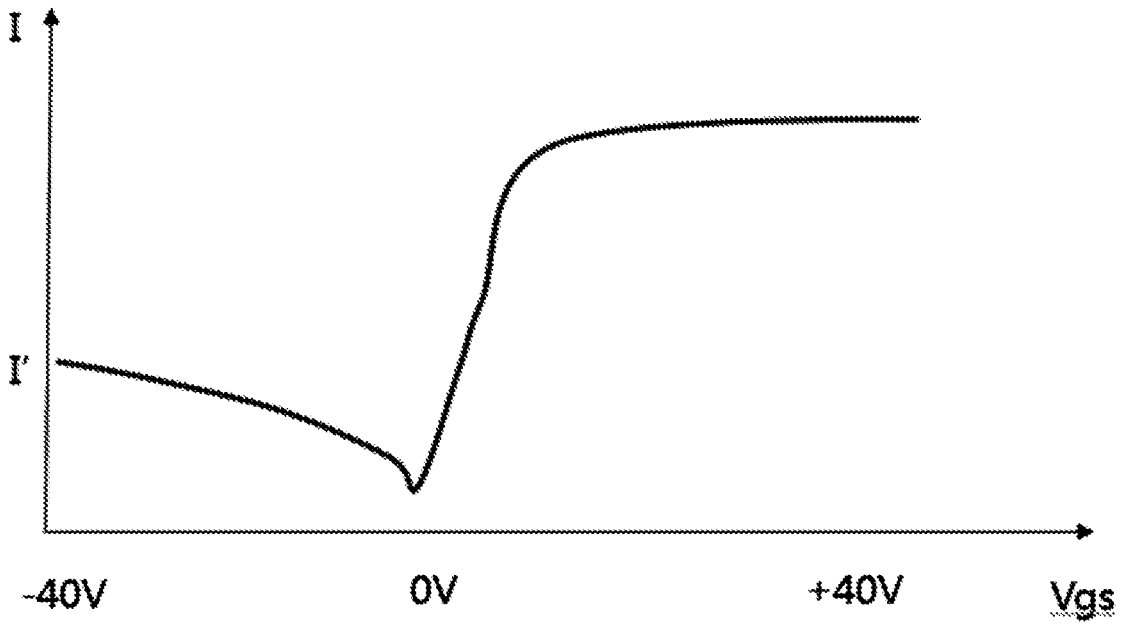
FIG. 7 is a diagram for a characteristic curve of transistor leakage current and gate-source electric voltage.
Figure 8:
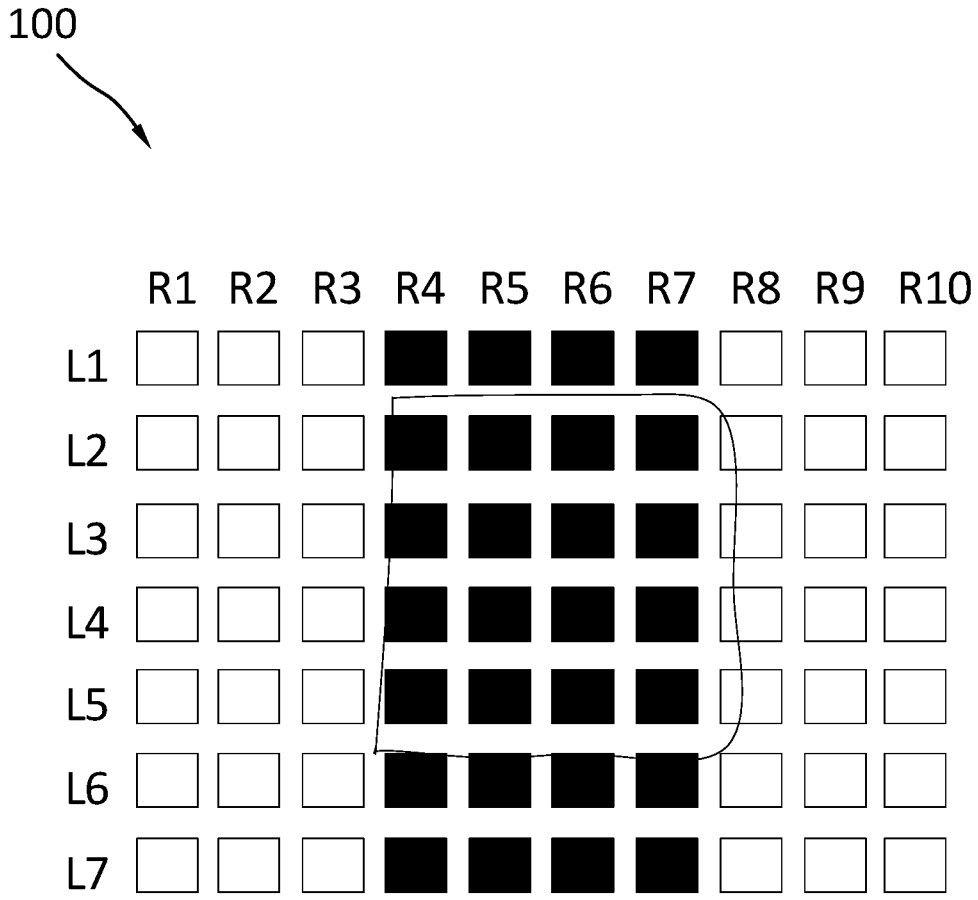
FIG. 8 is a diagram showing the movement of a liquid droplet in the microfluidic apparatus in the presence of a leakage current.

FIG. 1 schematically shows a structural diagram of a microfluidic apparatus 100. FIG. 2 is a diagram for an electrode drive circuit of the microfluidic apparatus 100. FIG. 3 is a structural diagram of a circuit of the microfluidic apparatus 100. The microfluidic apparatus 100 comprises a plurality of drive electrodes 1 arranged in an array and a common electrode 3. The common electrode 3 is connected to an electric ground (GND). The drive circuit comprises a transistor T (e.g., an n-channel transistor). A control terminal (i.e., gate electrode) of the transistor T receives a control signal (Gate). A first terminal (i.e., source electrode) of the transistor T receives a drive signal (Data). A second terminal (i.e., drain electrode) of the transistor T is connected with one of the drive electrodes 1 of the microfluidic apparatus 100. When the control signal (Gate) is at a high level, the transistor T is turned on, and the drive signal (Data) charges the drive electrode 1. As shown in FIG. 1 and FIG. 3, the drive electrodes 1 may be arranged in an array. Each of the drive electrodes 1 may be connected with a drive circuit as shown in FIG. 2. The drive electrodes 1 in same column are connected with same drive signal line (Data line). The drive electrodes 1 in same row are connected with same scanning line (Gate line). The operating principle of the microfluidic apparatus 100 is illustrated by directional stretching of a liquid droplet 2 as an example. FIG. 4-6 show a diagram showing the liquid droplet 2 being driven in the microfluidic apparatus 100. When the liquid droplet 2 needs to be stretched to a direction (e.g., the right direction of FIGS. 4-6), groups of drive electrode (R4, L3), (R4, L4); (R5, L3), (R5, L4); (R6, L3), (R6, L4); (R7, L3), (R7, L4); (R8, L3), (R8, L4) can be sequentially charged, thereby causing movement of the liquid droplet 2 along these charged drive electrodes. Here, filled square frames represent drive electrodes that are charged. Charging the drive electrodes can be achieved as follows. As shown in FIG. 4, first, a high level is sent through control signal lines of row L3 and row L4 to turn on the transistors T of the drive circuits in row L3 and row L4. The control signal lines of the other rows output a low level to turn off the transistors T of the drive circuits in the other rows. Then, charging signal is supplied through a drive signal line in column R4 to a drive circuit in the column R4, to charge the drive electrode (R4, L3) and drive electrode (R4, L4). Then, as shown in FIG. 5 and FIG. 6, charging signals are supplied sequentially through drive signal lines of columns R5, R6, R7 and R8 to the drive circuits in these columns, causing sequential charging of the groups of drive electrodes (R6, L3), (R6, L4); (R7, L3), (R7, L4); (R8, L3), (R8, L4). However, electric voltage used for driving a liquid droplet is generally tens of volts to hundreds of volts. Namely, the electric voltage of the drive signals needs to be tens of volts to hundreds of volts. Even if the control ends of the transistors in the other rows except the row L3 and the row L4 receive a low level to turn off these transistors, the electric voltage between the first terminal and the control terminal of these transistors can still reach tens of volts to hundreds of volts. FIG. 7 shows a characteristic curve of the leakage current as a function of the gate-source electric voltage of the transistors. As shown in FIG. 7, when the gate-source electric voltage Vgs of the transistor (namely, difference between electric voltage of the control terminal and electric voltage of the first terminal of the transistor T) is large, the leakage current I in the transistor is large. The leakage current I may reach a level of $10^{-10}$ A. FIG. 8 is a diagram showing the movement of a liquid droplet in the microfluidic apparatus 100 in the presence of the leakage current. The leakage current I can charge all the drive electrodes in columns R4, R5, R6, R7 and R8 within a short time, which disrupts directional flow the liquid droplet, as shown in FIG. 8.

Figure 9:
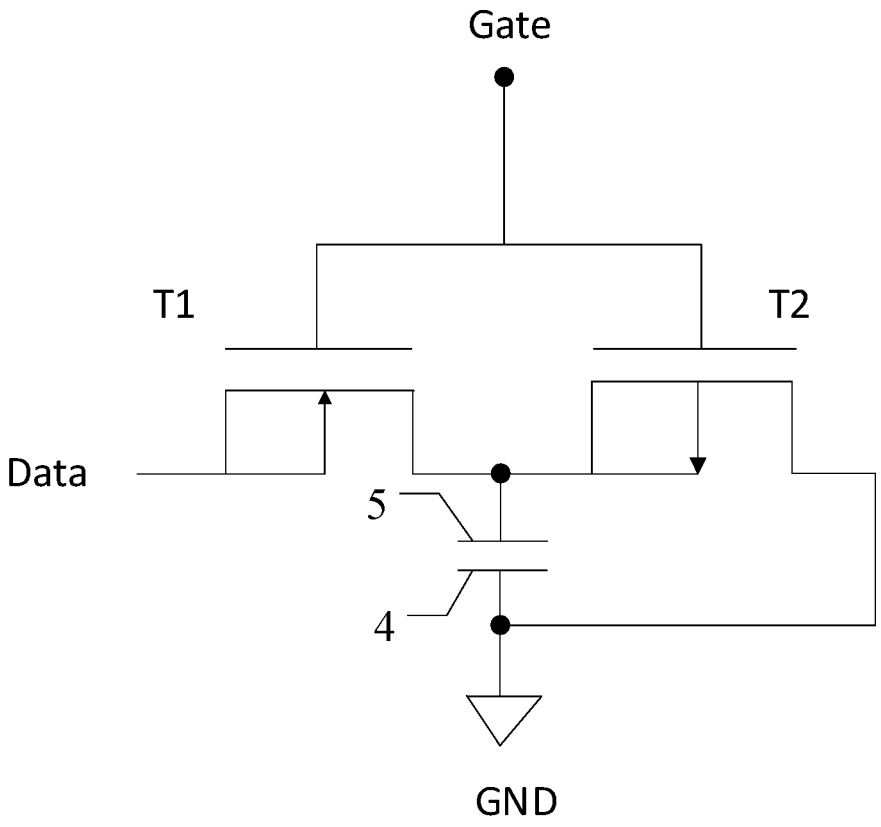
FIG. 9 is a circuit diagram of a drive circuit, according to an embodiment.

FIG. 9 is a circuit diagram of a drive circuit of a microfluidic apparatus 200, according to an embodiment. The microfluidic apparatus 200 comprises a first electrode (e.g., a drive electrode 5) and a second electrode (e.g., a common electrode 4). The first electrode and the second electrode face each other and are separated by a gap configured to accommodate a liquid droplet. The drive circuit 5 comprises a first switch T1 (e.g., a first transistor) and a second switch T2 (e.g., a second transistor). The first switch T1 is configured to apply a drive signal (Data) to a first electrode (e.g., the drive electrode 5) when the first switch T1 receives a control signal (Gate). The second switch T2 is configured to electrically isolate the first electrode from a second electrode (e.g., the common electrode 4) when the second switch T2 receives the control signal (Gate). The second switch T2 is configured to short-circuit the first electrode (e.g., the drive electrode 5) to the second electrode (e.g., the common electrode 4) when the second switch T2 does not receive the control signal (Gate). For example, the control signal (Gate) here may be a high level of electric voltage or a low level of electric voltage.

In an embodiment, the first switch T1 is a transistor T1 (e.g., an enhancement-mode transistor). A first terminal (i.e., source electrode) of the first transistor T1 receives a drive signal (Data). A second terminal (i.e., drain electrode) of the first transistor T1 is connected with the drive electrode 5. A control terminal (i.e., gate electrode) of the first transistor T1 receives control signal (Gate). In an embodiment, the second switch T2 is a transistor T2 (e.g., a depletion-mode transistor). A first terminal (i.e., source electrode) of the second transistor T2 is connected with the drive electrode 5. A second terminal (i.e., drain electrode) of the second transistor T2 is connected with the common electrode 4. A control terminal (i.e., gate electrode) of the second transistor T2 receives the control signal (Gate). The first transistor T1 and the second transistor T2 are of different types. The common electrode 4 is connected with the electric ground (GND). In an embodiment, the first switch T1 is a p-channel transistor and the second switch T2 is an n-channel transistor. In an embodiment, the first switch T1 is an n-channel transistor and the second switch T2 is a p-channel transistor.

When the drive electrode 5 is targeted (i.e., being intended to be charged), the first transistor T1 is turned on by the control signal (Gate), the second transistor T2 is turned off by the control signal (Gate) and the drive signal (Date) charges the drive electrode 5 to establish an electric voltage between the drive electrode 5 and the common electrode 4, which causes a liquid droplet to move. When the drive electrode 5 is not targeted (i.e., not being intended to be charged), the first transistor T1 is turned off by the control signal (Gate), the second transistor T2 is turned on by the control signal (Gate) and prevents charging the drive electrode 5 even in the presence of the leakage current. Unwanted movement of the liquid droplet caused by a drive electrode that is not targeted can so be avoided.

According to an embodiment, as shown in FIG. 9, the first transistor T1 may be an n-channel transistor, and the second transistor T2 may be a p-channel transistor. The logic level of the control signal (Gate) to turn on the first transistor T1 can a high level, and the logic level of the control signal (Gate) to turn off the first transistor T1 is a low level. The logic level of the control signal (Gate) to turn on the second transistor T2 is the low level, and the logic level of the control signal (Gate) to turn off the second transistor T2 is the high level. When the control signal (Gate) is at the low level, the first transistor T1 is turned off and the second transistor T2 is turned on. When the control signal (Gate) is at the low level, even if there is a leakage current through the first transistor T1 to the drive electrode 5, the second transistor T2, which is turned on, can discharge the drive electrode 5. When the control signal (Gate) is at the high level, the first transistor T1 is turned on and the second transistor T2 is turned off, to allow the drive signal (Data) to charge the drive electrode 5.

According to an embodiment, the first transistor T1 may be a p-channel transistor, and the second transistor T2 may be an n-channel transistor. The logic level of the control signal (Gate) to turn on the first transistor T1 is the low level, and the logic level of the control signal (Gate) to turn off the first transistor T1 is the high level. The logic level of the control signal (Gate) to turn on the second transistor T2 is the high level, and the logic level of the control signal (Gate) to turn off the second transistor T2 is the low level. When the control signal (Gate) is at the high level, the first transistor T1 is turned off and the second transistor T2 is turned on. When the control signal (Gate) is at the high level, even if there is a leakage current through the first transistor T1 to the drive electrode 5, the second transistor T2, which is turned on, can discharge the drive electrode 5. When the control signal (Gate) is at the low level, the first transistor T1 is turned on and the second transistor T2 is turned off, to allow the drive signal (Data) to charge the drive electrode 5.

Figure 10:
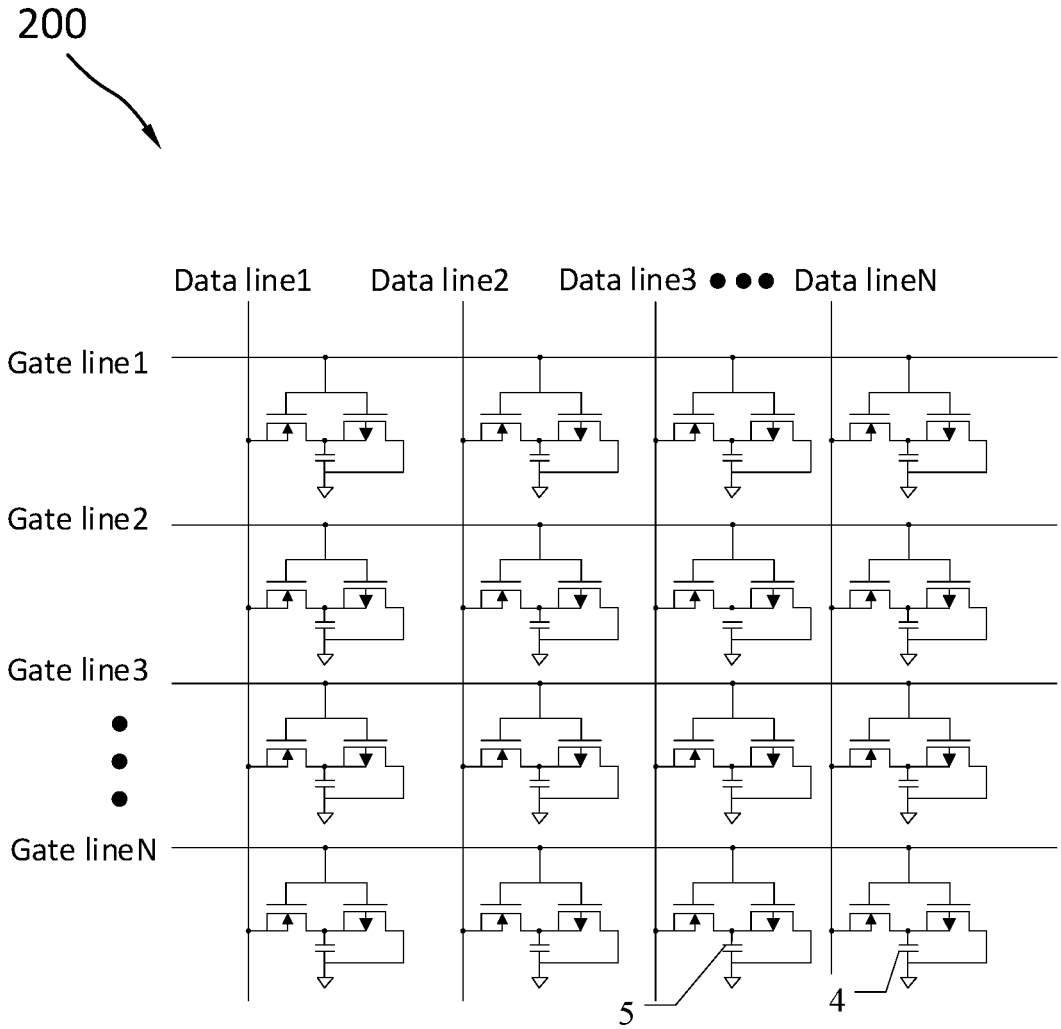
FIG. 10 schematically shows the structure of a microfluidic apparatus, according to an embodiment.

FIG. 10 schematically shows the structure of the microfluidic apparatus 200, according to an embodiment. The microfluidic apparatus 200 may include comprise multiple drive electrodes (e.g., the drive electrode 5) arranged in an array. The array of drive electrodes is arranged opposite to the common electrode 4. Each of the drive electrodes in the array is connected with the electrode drive circuit of FIG. 9. The microfluidic apparatus 200 may further comprise a first hydrophobic layer, a second hydrophobic layer, a first substrate and a second substrate. The first substrate and the second substrate are oppositely arranged. The common electrode 4 is arranged on a side of the first substrate. This side faces the second substrate. The array of drive electrodes is arranged on a side of the second substrate. This side faces the first substrate. The first hydrophobic layer is arranged on a side of the common electrode 4. This side faces the array of drive electrodes. The second hydrophobic layer is arranged on a side of the array of drive electrodes. This side faces the common electrode 4. A gap to accommodate a liquid droplet is formed between the first hydrophobic layer and the second hydrophobic layer.

Although transistors are described herein as examples of the switches, other types of switches may be suitable. The drive signal (Data) and the control signal (Gate) may be in a form appropriate for the first switch T1 and the second switch T2 and are not limited to electric voltages. Examples of the drive signal (Data) and the control signal (Gate) may be light intensity, temperature, electric current, and frequency or amplitude of changes of a physical quantity. According to an embodiment, the microfluidic apparatus 200 further comprises a plurality of scanning lines (Gate lines) and a plurality of drive lines (Data lines). The plurality of scanning lines extends along rows of the array of drive electrode, to supply the control signal (Gate). The plurality of drive lines extends along columns of the array of drive electrode, to supply the drive signal (Data).

According to an embodiment, a drive method of a microfluidic apparatus is disclosed. The method is applicable to the microfluidic apparatus 200 described above. The method comprises: supplying a drive signal to charge a drive electrode, and supplying a control signal that turns on the first transistor and turns off the second transistor or a control signal that turn off the first transistor and turn on the second transistor.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus comprising:

a first switch and a second switch;

wherein the first switch is configured to apply a drive signal to a first electrode when the first switch receives a control signal;

wherein the second switch is configured to electrically isolate the first electrode from a second electrode when the second switch receives the control signal;

wherein the second switch is configured to short-circuit the first electrode to the second electrode when the second switch does not receive the control signal;

wherein the first electrode and the second electrode face each other and are separated by a gap configured to accommodate a liquid droplet.

2. The apparatus of claim 1, wherein the first switch is a transistor;

wherein a gate electrode of the transistor is configured to receive the control signal;

wherein a source electrode of the transistor is configured to receive the drive signal and a drain electrode of the transistor is electrically connected to the first electrode, or the drain electrode is configured to receive the drive signal and the source electrode is electrically connected to the first electrode.

3. The apparatus of claim 1, wherein the second switch is a transistor;

wherein a gate electrode of the transistor is configured to receive the control signal;

wherein a source electrode of the transistor is electrically connected to the first electrode and a drain electrode of the transistor is electrically connected to the second electrode, or the drain electrode is electrically connected to the first electrode and the source electrode is electrically connected to the second electrode.

4. The apparatus of claim 1, wherein the drive signal is an electric voltage.

5. The apparatus of claim 1, wherein the control signal is an electric voltage.

6. The apparatus of claim 1, wherein the first switch is an enhancement-mode transistor.

7. The apparatus of claim 1, wherein the second switch is a depletion-mode transistor.

8. The apparatus of claim 1, wherein the first switch is a p-channel transistor and the second switch is an n-channel transistor; or wherein the first switch is an n-channel transistor and the second switch is a p-channel transistor.

9. The apparatus of claim 1, further comprising the first electrode and the second electrode.

10. The apparatus of claim 9, wherein the gap is confined in a channel configured to allow flow of the liquid droplet.

11. The apparatus of claim 1, further comprising a first substrate and a second substrate; wherein the first electrode is on the first substrate and the second electrode is on the second substrate.

12. The apparatus of claim 11, wherein the first substrate comprises an array of electrodes comprising the first electrode.

13. The apparatus of claim 1, wherein the gap is lined by a layer of hydrophobic material.

14. The apparatus of claim 1, further comprising a signal source configured to supply the drive signal.

15. A method comprising:

supplying a drive signal to a first electrode while the first electrode is electrically isolated from a second electrode;

short-circuiting the first electrode to the second electrode while not supplying the drive signal to the first electrode;

wherein the first electrode and the second electrode face each other and are separated by a gap configured to accommodate a liquid droplet.

16. The method of claim 15, wherein the drive signal is an electric voltage.

17. The method of claim 15, wherein supplying the drive signal to the first electrode attracts a liquid droplet into the gap.

* * * * *